United States Patent [19]

Kramski

[11] Patent Number: 4,543,865

[45] Date of Patent: Oct. 1, 1985

[54] PUNCH PRESS TOOL FOR PUNCHING SMALL HOLES IN A STRIP OF SHEET METAL, AND OBTAINING SMALL PUNCHED BLANKS

[75] Inventor: Wiestaw Kramski, Pforzheim, Fed. Rep. of Germany

[73] Assignee: Kramski GmbH Prazisionswerkzeuge-Metallwaren, Birkenfeld, Fed. Rep. of Germany

[21] Appl. No.: 492,448

[22] Filed: May 6, 1983

[30] Foreign Application Priority Data

Jun. 15, 1982 [DE] Fed. Rep. of Germany ..... 3222440

[51] Int. Cl.[4] ..... B21D 45/08

[52] U.S. Cl. ..... 83/146; 83/97; 83/164; 83/685; 83/690

[58] Field of Search ..... 83/164, 97, 685, 690, 83/145, 146

[56] References Cited

U.S. PATENT DOCUMENTS

| | | | |
|---|---|---|---|
| 522,953 | 7/1894 | Bradley | 83/690 X |
| 915,659 | 3/1909 | Clark | 83/690 X |
| 956,434 | 4/1910 | Schwartz | 83/690 |
| 2,404,793 | 7/1946 | Dickerman | 83/685 |
| 2,604,167 | 7/1952 | Oliver | 83/690 X |
| 3,031,905 | 5/1962 | Phillips et al. | 83/164 X |
| 3,580,122 | 5/1971 | Powell | 83/685 X |
| 4,198,884 | 4/1980 | Nakagawa et al. | 83/690 X |

*Primary Examiner*—Frank T. Yost

*Attorney, Agent, or Firm*—Frishauf, Holtz, Goodman & Woodward

[57] ABSTRACT

To permit punching of very small holes from a strip of sheet metal, for example to form a sequence of holes at the margin thereof, or to obtain small punched blanks, having diameters of a few millimeters, for example 1–2 mm or even less, and prevent adhesion of the punched blanks to a reciprocating punch plunger (1), the punch die (4) is formed with a shallow groove (8) in the wall of the opening (5) of a die, the groove extending either spirally or axially for the depth of penetration or stroke of the punch plunger. Upon withdrawal of the plunger, a small projection or nose which will have formed in the region of the groove will wedge or jam therein, thus preventing upward travel of the blank with the withdrawing reciprocating tool. Preferably, the opening is slightly conical, with a cone angle of, for example, about ½° with respect to the axis (12) of the bore (5); a suitable angle of inclination for a spiral groove is, for example, 12°, and a suitable plunger penetration, for example with a straight, axially extending groove, is about 1 mm.

20 Claims, 3 Drawing Figures

PUNCH PRESS TOOL FOR PUNCHING SMALL HOLES IN A STRIP OF SHEET METAL, AND OBTAINING SMALL PUNCHED BLANKS

The present invention relates to a punch press tool, and more particularly to a punch press tool capable of cutting punched blanks of small diameter, for example a diameter in the order of a few millimeters, for example 2–3 mm.

BACKGROUND

Various types of punch press tools are known in order to punch holes into a strip of sheet metal, and to derive punched blanks from the strip of sheet metal. Such punch press tools are used frequently in automatic punch presses and punching machines. The usual machines of this type have elements to guide a strip therethrough, and a reciprocating punch press tool is guided over the strip into a die in predetermined position, for example to punch a sequence of holes in the marginal portions of a band or tape of the metal strip. The desired result may be, either, the punching of holes into the metal strip or to obtain punched blanks.

Punch presses of this type have the problem that the punched blanks must be reliably carried away from the punch die, for example through a longitudinal bore therein, as soon as the punch press tool reciprocates. This problem arises regardless of whether the punched blanks are to be considered scrap—for example when the purpose of the tool is to punch a sequence of holes into the metal strip—or if the punched blanks themselves are to be the articles desired by the punching operation. Usually, the tool, and hence the punched blanks, will—in cross section—be circular.

Punching tools of this type, in which blanks are to be punched in excess of several millimeters diameter, frequently use a pressure element located centrally within the reciprocating punch press which, upon or after the punching operation, pushes the punched blank away from the surface of the punch press tool. This element, for example, is a spring or the like. When the size of the holes, and hence the size of the blanks, becomes very small, for example with circular diameters of 3 mm, 2 mm, or less, difficulties arise since it is no longer possible to place push-away or similar elements within the punch tool itself. As the punched blanks become smaller, however, the tendency of the blanks to adhere to the end face of the punch tool increases, primarily due to their light weight. Adhesion of punched blanks is additionally difficult to control if the surfaces of the strips from which the holes are punched are slightly adhesive, for example by having a thin coating of grease or the like. Various attempts have been made to prevent adhesion of the punched blanks to the punch press tool by special shaping of the cutting surface of the punch press tool. For example, it has been proposed to form the reciprocating punch tool with concave surfaces, or with converging surfaces, primarily in order to shape the punched blanks to have some angled portions, in order to prevent jamming of the punched blanks in the bore of the punching die and, further, to lift off the reciprocating punch press due to the springiness of the punched blank as it snaps back from the angled or bowed position to a flat position. Making the punch die in this shape, however, decreases its stability and, particularly if the punch die is of indented or roof-like shape, causes rapid wear of the cutting edge portions which project beyond other portions.

It has been attempted to decrease the cutting gap between the bore of the die and the reciprocating punch press tool. Closer tolerances of the tool-die combination, however, increases the wear on both of the tool elements, and thus decreases the effective operating time of the punch-die combination before re-grinding or re-surfacing of the elements is required. Further, the power requirements to effect punching are increased.

THE INVENTION

It is an object to improve a punch press-punch die tool combination so that the punched blanks are not held in position in the punched die or against the end face of the punch press tool, while retaining the dimensions which, in accordance with the state of technology, have been determined to be of maximum effectiveness for efficient punching of various metals of given thicknesses and hardness, and which is capable of punching blanks having nominal diameters of only a few millimeters, and, for example, diameters in the range of 3, or 2 mm, and even less.

Briefly, the die element of the punch press has a die well, or die opening, which is formed with at least one shallow groove extending in the direction of severing or punching movement of the reciprocating punch element for a length which is at least as long as the depth of projection of the punch element into the punch die.

The groove may extend parallel to the direction of punching operation, or it may extend in spiral or inclined form, with small circumferential angle with respect to the axis of the bore or well of the die, and through and into an extending conical portion of the die.

It has been found that the punched blank will be formed with a tiny projection due to the presence of the groove which, at the end of the punch stroke of the punch die, has the tendency to jam against the wall of the bore or well of the die, so that, upon upwardly reciprocating movement of the punch press tool, the blank will be retained securely within the bore or well of the die. If the groove extends parallel to the direction of punching movement, for example exactly axially, the punched blank is pushed over its entire length and beyond the longitudinal extent of the groove. If the groove extends spirally, the punched blank will clamp or jam in the groove since, upon return movement of the punch press tool, which is non-rotary, the blank cannot follow the linear return movement of the punch tool, since it cannot rotate with respect to the punch tool due to friction against the walls of the punch die and the groove.

The simple provision of a shallow groove, extending axially for the length of the stroke of the punch tool, or longer if spirally, insures that the punched blanks will not follow the punch press or punch stamp upon its return reciprocating movement, so that damage or malfunction is reliably prevented.

It has been found that the holes punched from sheet metal element are identical to those which are punched from dies which do not have the groove, since the actual punching operation is determined by the cutting edge of the reciprocating press punch element.

It is, of course, possible to form more than one such groove—extending axially or slightly spiralled—around the circumference of the punching well or bore. Preferably, the grooves will be uniformly distributed around the circumference and, for example, two or three are appropriate.

If it is desired to utilize a spiral groove, then good results have been achieved if the angle between the spiral and the axis of the bore is in the range of between 10° and 20°. Particularly good results have been obtained with an angle of inclination of about 12°.

The lower die element preferably enlarges conically slightly, for example with a cone angle of between 8 minutes to 1°.

The dimension of the groove itself is highly dependent on the material from which the punched blanks are to be cut, its hardness, ductility, strength, and material composition, as well as, of course, the thickness thereof. Groove depths in the range of between 0.005 to 0.2 mm have been found suitable for various materials and thicknesses. The relationship of the depth of the groove to the strength of the material to be worked—which includes a thickness factor—can be readily determined experimentally; in thin sheet-metal elements, a shallow groove is sufficient; sheet metal strips which are thicker, or are made of tougher material, are preferably worked with grooves of deeper dimension. The width of the groove is also determined in part by the depth thereof; as the depth increases, the width likewise increases, and a suitable relation of width to depth is in the order of between 1:1 to 5:1, although other dimensions are equally suitable. The depth and width relationships can be readily determined by a few simple try-outs with the respective strips and strip materials to be cut or punched.

DRAWINGS

Figure 1:
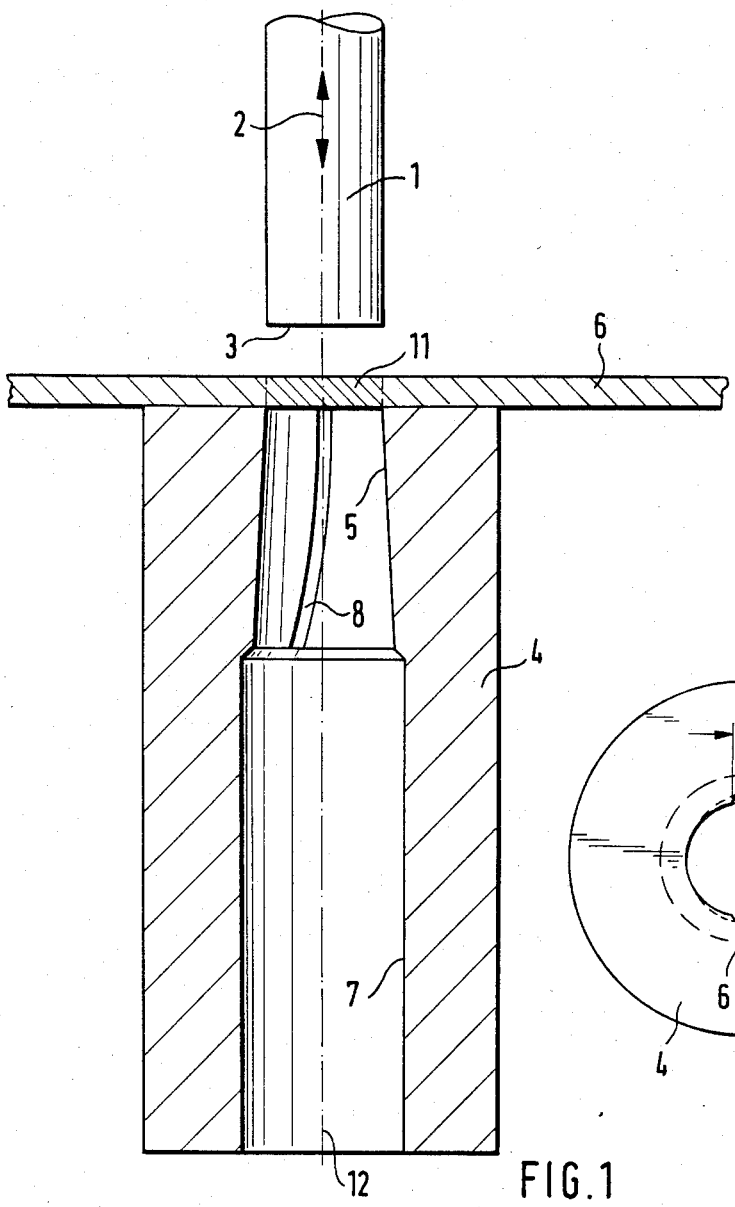
FIG. 1 is a schematic longitudinal view through a punch press in accordance with the invention.
Figure 2:
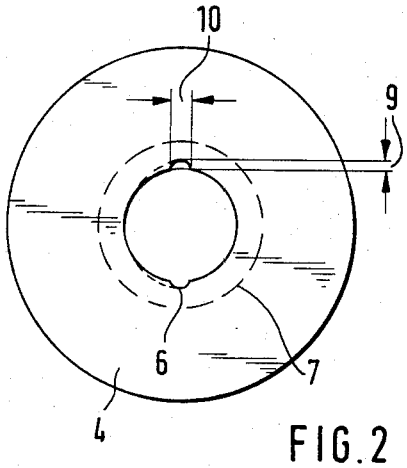
FIG. 2 is a top view of the lower punch die of FIG. 1.

The punch press has an upper punch press tool 1, in form of a punch plunger of, for example, circular diameter. The plunger 1 reciprocates as schematically indicated by arrow 2. It has a flat cutting surface 3, to cooperate with a punch die 4. The punch die 4 has a bore or opening or well 5 therein. The opening 5 expands conically, for example by a cone angle of 0.5°. The conical angle is shown exaggerated in the drawing.

The conical bore 5 merges into a cylindrical bore 7 of larger diameter, large enough to permit the stamped blanks to fall freely through the opening 7.

A sheet-metal strip 6 is placed across the mouth or upper end of the opening 5. Upon reciprocation of the plunger 1, a blank 11 will be cut from the sheet-metal strip 6.

In accordance with the invention, the conical bore 5 is formed with two spirally extending inclined grooves 8. The grooves 8 have a depth 9 which depends on the thickness of the sheet metal 6, as well as on the diameter of the punched blanks. The depth of the grooves 8, for extremely small blanks, may be as small 0.001 mm, but may extend up to about 0.2 mm. The lower values are used for thin sheet-metal elements and very small cross-sectional dimensions of the blanks 11. The higher levels are suitable for thicker sheets 6 and larger diameters. The width 10 of the grooves depends, proportionately, on the depth and may, for example, be between about the same to about four to five times the depth.

OPERATION

The blank 11, which is punched out of strip 6, upon reciprocation of the press plunger or punch plunger 1, will be formed with a small projection or nose. As the plunger 1 is inserted into the bore and continues to push the blank 11, the projection will become wedged at its edge in the groove 8, since the blank 11 cannot follow the inclined or spiral path of the groove 8 by rotating due to the high frictional forces with respect to the cutting plunger 1. Consequently, the blank 11 will be wedged in the die 4, and the plunger 1 can freely reciprocate upwardly without adhesion by the blank 11. Upon a subsequent cutting operation, the blanks 11 which are already within the bore 5 are pushed downwardly by the subsequently cut blanks 11 until, due to the increase in diameter as a result of the conical enlargement of the bore 5, the clamping or wedging effect of the groove and the nose or projection on the blanks will be lost, and the blanks can fall freely downwardly through the enlarged opening 7. The plunger does not rotate.

Figure 3:
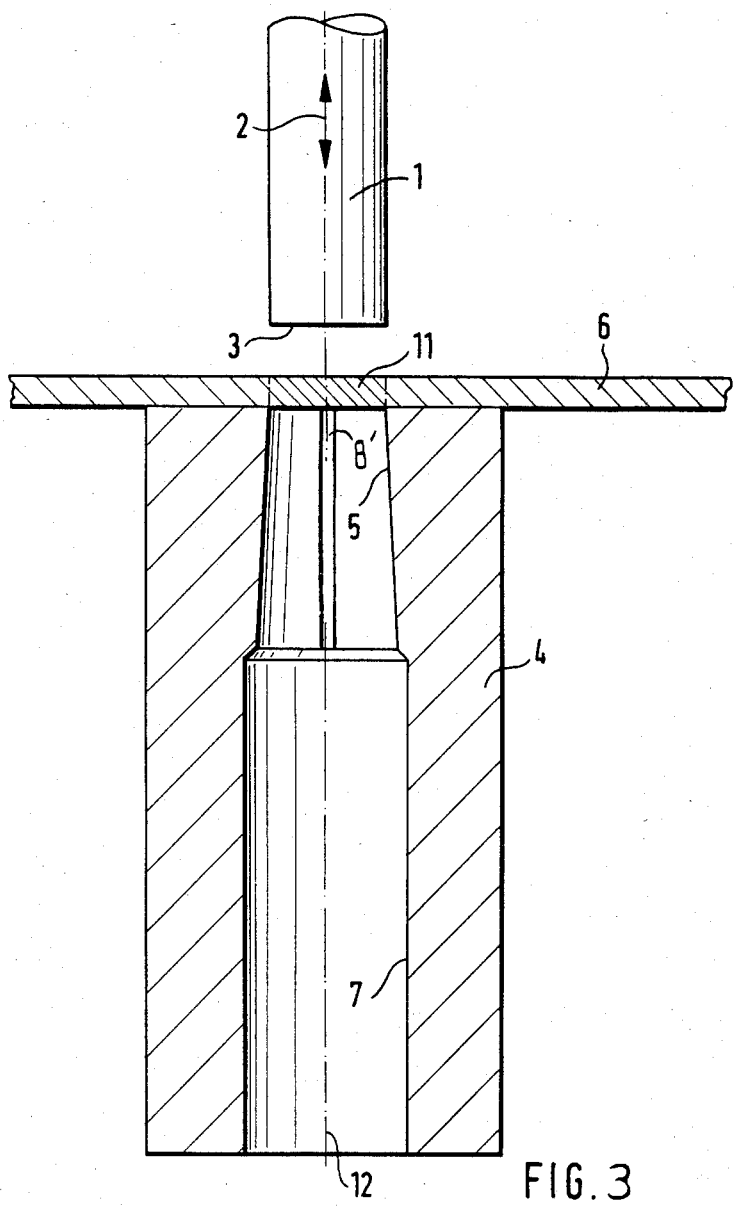
FIG. 3 is a view similar to FIG. 1, and showing another embodiment.

The groove 8 need not extend in a spiral direction. A groove 8' can be cut longitudinally (see FIG. 3), that is, parallel to the axis 12 of the bore 5. If so made, then preferably the length of the groove 8' from the lower surface of the sheet-metal element 6 is so dimensioned that it corresponds to the depth of insertion of the plunger 1 into the bore 5. For example, if the plunger 1 extends into the die 4 by 1 mm, then the longitudinal extent of the groove 8' should be 1 mm, and end there. The operating effect of the groove 8' will be the same as that of the spiral groove 8 of FIG. 1 since the projection formed by the groove 8' will be pushed by the cutting plunger over the edge of the groove 8', so that the projection will wedge itself in the then smooth wall of the opening 5 of the die 4. As subsequent blanks 11 are cut, the first blank, downwardly, will again be pushed into the region of conical enlargement where it can fall freely through the opening 7.

A suitable cone angle of the bore 5 with respect to the axis 12 is in the range of from about 8 minutes to 1°. The exact cone angle will depend on the characteristics of the material 6. It is, of course, desirable to permit the punched parts to become released from the walls of the well or bore 5 as quickly as possible, so that the power requirement to push the blank downwardly by the subsequent blanks may remain as small as possible. The relative dimensions of the cross section of the upper portion of the bore 5, and of the plunger or cutting punch 1, may be selected as well known and as customary in punching technology.

The hole formed in the sheet metal element 6 will remain circular and will not be deformed due to the presence of the groove since the shape of the hole is determined by the diameter of the punch or plunger element 1. If a spiral groove is selected, a preferred angle of inclination with respect to axis 12 is 12°, although the angle may vary widely, and, suitably, between 10° to 20°.

Various changes and modifications may be made within the scope of the inventive concept.

For punching holes of 2,0 mm in a strip of lenouve (metal), having a thickness of 0,5 mm a groove 8 of 0,02 mm width, 3,5 mm depth, is suitable.

I claim:

1. Punch press tool for punching small disk elements or blanks (11) from sheet material (6) having a punch die (4) being formed with a continuous receiving and removal opening (5) for the disk elements or blanks;

and a punch press element (1) having an outer shape and diameter fitting into the opening (5) of the die, reciprocatingly operable to enter into the opening for entirely severing a disk element or blank (11) from the sheet material, and remove the disk element or blank from the punch die, the punch press element withdrawing from the punch die after having entered the punch die;

wherein, in accordance with the invention the wall of the opening (5) of the punch die is formed with at least one shallow groove (8) having a dimension small with respect to the surface area of the disk elements or blanks extending in the direction of the severing movement of the punch press element (1) and for a length which is at least as long as the depth of penetration of the punch press element into the opening of the punch die; and wherein the punch press element has an outer shape which corresponds to the surface configuration of the disk element or blank and spans, but does not enter said shallow groove (8), whereby, upon entering of the punch press element into the die, the punch press element will punch out a disk element or blank from the sheet material in the shape of the punch press, the disk element or blank being formed with a small projection extending into the groove, said small projection frictionally engaging in the groove and thus inhibiting undesired following, or adhesion of the disk element or blank to the punch element upon withdrawal operation of the punch element from said opening.

2. Tool according to claim 1, wherein the groove (8) extends parallel to the direction of severing movement of the punch press element (1) and for a length corresponding essentially to the depth of penetration of the punch press element (1) into the opening (5) of the die (4).

3. Tool according to claim 2, wherein said opening is of circular diameter, and is slightly conical, tapering outwardly in the direction of penetrating movement of the punch press element (1) with a cone angle of between about 8 minutes to 1°.

4. Tool according to claim 1, wherein the groove (8) extends spirally with respect to the axis of penetrating movement of the punch press element (1) into the opening (5) of the die.

5. Tool according to claim 4, wherein the length of the groove extends beyond the depth of penetration of the punch press element (1) into the opening (5) of the die.

6. Tool according to claim 4, wherein the opening (5) has a first portion having a length corresponding at least to the depth of penetration of the punch press element (1) thereinto;

and a second portion which is conically enlarged with respect to the first portion;

and wherein the spiral groove extends throughout said first portion and up to the second portion.

7. Tool according to claim 6, wherein the angle of inclination of the groove with respect to the axis of penetrating movement of the punch press element (1) is in the range of between 10° and 20°.

8. Tool according to claim 7, wherein the angle of inclination is about 12°.

9. Tool according to claim 8, wherein said first portion has circular diameter and extends outwardly, in the direction of penetrating movement of the punch press element, slightly conical with a cone angle of between 8 minutes to 1°.

10. Tool according to claim 4 wherein the punch press element (1) is operable in said reciprocating movement while being restrained from rotary movement about the axis of reciprocation.

11. Tool according to claim 4 wherein the punch press element (1) is operable in said reciprocating movement which includes an insertion stroke portion and a withdrawal portion, said punch press element being restrained from rotary movement at least during said withdrawal portion.

12. Tool according to claim 1, wherein the opening (5) has a first portion having a length corresponding at least to the depth of penetration of the punch press element (1) thereinto;

and a second portion which is conically enlarged with respect to the first portion.

13. Tool according to claim 12, wherein said first portion has circular diameter and extends outwardly, in the direction of penetrating movement of the punch press element, slightly conical with a cone angle of between 8 minutes to 1°.

14. Tool according to claim 1, wherein said opening is of circular diameter, and is slightly conical, tapering outwardly in the direction of penetrating movement of the punch press element (1) with a cone angle of between about 8 minutes to 1°.

15. Tool according to claim 14, wherein the cone angle of the opening (5) is in the order of about ½ degree.

16. Tool according to claim 14, wherein the diameter of the opening (5) is less than about 3 mm;

and the depth of the groove is between about 0.005 and 0.2 mm.

17. Tool according to claim 16, wherein the groove (8) extends parallel to the direction of severing movement of the punch press element (1) and for a length corresponding essentially to the depth of penetration of the punch press element (1) into the opening (5) of the die (4).

18. Tool according to claim 16, wherein the groove (8) extends spirally with respect to the axis of penetrating movement of the punch press element (1) into the opening (5) of the die.

19. Tool according to claim 1, wherein the diameter of the opening (5) is less than about 3 mm.

20. Tool according to claim 1, wherein the depth of the groove is between about 0.005 and 0.2 mm.

* * * * *